US010030485B2

(12) United States Patent
Gourmelon

(10) Patent No.: US 10,030,485 B2
(45) Date of Patent: Jul. 24, 2018

(54) METHODS AND APPARATUS FOR COLLECTING DEBRIS AND FILTERING FLUID

(71) Applicant: Schlumberger Technology Corporation, Sugar Land, TX (US)

(72) Inventor: Pierre-Olivier Gourmelon, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 232 days.

(21) Appl. No.: 14/884,577

(22) Filed: Oct. 15, 2015

(65) Prior Publication Data

US 2017/0107798 A1 Apr. 20, 2017

(51) Int. Cl.

| | |
|---|---|
| ***E21B 43/08*** | (2006.01) |
| ***E21B 43/38*** | (2006.01) |
| ***E21B 43/12*** | (2006.01) |

(52) U.S. Cl.

CPC ..... *E21B 43/08* (2013.01); *E21B 43/121* (2013.01); *E21B 43/38* (2013.01)

(58) Field of Classification Search

CPC combination set(s) only.
See application file for complete search history.

(56) References Cited

U.S. PATENT DOCUMENTS

| | | | |
|---|---|---|---|
| 5,230,388 | A | 7/1993 | Cherrington |
| 5,295,537 | A | 3/1994 | Trainer |
| 5,402,850 | A | 4/1995 | Lalande et al. |
| 5,447,200 | A | 9/1995 | Dedora et al. |
| 6,189,617 | B1 | 2/2001 | Sorhus et al. |
| 6,220,347 | B1 | 4/2001 | Head |
| 6,276,452 | B1 | 8/2001 | Davis et al. |
| 6,427,776 | B1 | 8/2002 | Hoffman et al. |
| 6,474,349 | B1 | 11/2002 | Laker |
| 6,581,689 | B2 * | 6/2003 | Hailey, Jr. ..... E21B 43/08 166/228 |
| 6,640,904 | B2 | 11/2003 | Hoffman et al. |
| 6,719,050 | B2 | 4/2004 | Longacre |
| 6,745,839 | B1 | 6/2004 | Simpson |
| 6,883,605 | B2 | 4/2005 | Arceneaux et al. |
| 6,978,841 | B2 | 12/2005 | Hoffman et al. |
| 7,040,395 | B2 | 5/2006 | Booth |
| 7,472,745 | B2 | 1/2009 | Lynde et al. |

(Continued)

OTHER PUBLICATIONS

Extended Search Report issued in the related EP application 16193759.4, dated Nov. 24, 2016 (7 pages).

*Primary Examiner* — Kyle Armstrong
(74) *Attorney, Agent, or Firm* — Sara K. M. Hinkley

(57) ABSTRACT

A debris removal apparatus includes a housing. The housing has a chamber located therein. The chamber has at least one closed end. The debris removal apparatus can also include a first flow path. The first flow patch can be in communication with an opening in the first end of the housing. The first flow path can also have an exit, and a diverter can be located adjacent to the exit. A port can be located between the diverter and the exit of the first flow path. The port can be in fluid communication with the first flow path and the chamber. The chamber can be in communication with a second flow path, and a screen operatively positioned between the chamber and second flow path.

13 Claims, 3 Drawing Sheets

(56) References Cited

U.S. PATENT DOCUMENTS

| | | | |
|---|---|---|---|
| 7,497,260 | B2 | 3/2009 | Telfer |
| 7,513,303 | B2 | 4/2009 | Hern |
| 7,610,957 | B2 | 11/2009 | Davis et al. |
| 7,779,901 | B2 | 8/2010 | Davis et al. |
| 7,793,717 | B2 | 9/2010 | Davison |
| 7,861,772 | B2 | 1/2011 | Blair |
| 8,056,622 | B2 | 11/2011 | Lynde |
| 8,109,331 | B2 | 2/2012 | Lynde et al. |
| 8,225,859 | B1 | 7/2012 | Moidel et al. |
| 8,240,373 | B1 | 8/2012 | Britton et al. |
| 8,257,585 | B2 | 9/2012 | Davis et al. |
| 8,453,724 | B2 | 6/2013 | Zhou |
| 8,474,522 | B2 | 7/2013 | Lynde et al. |
| 8,584,744 | B2 | 11/2013 | Soni et al. |
| 8,607,857 | B2 | 12/2013 | Lynde et al. |
| 8,664,563 | B2 | 3/2014 | Abbasi et al. |
| 8,967,241 | B2 | 3/2015 | Xu et al. |
| 8,973,662 | B2 | 3/2015 | Xu et al. |
| 2010/0258296 | A1 | 10/2010 | Lynde et al. |
| 2010/0258297 | A1 | 10/2010 | Lynde |
| 2010/0288492 | A1 | 11/2010 | Blackman et al. |
| 2012/0152522 | A1 | 6/2012 | Lynde |
| 2014/0311528 | A1 | 10/2014 | Hallundbaek |

* cited by examiner

METHODS AND APPARATUS FOR COLLECTING DEBRIS AND FILTERING FLUID

FIELD OF THE DISCLOSURE

The disclosure generally relates to methods and apparatus for collecting debris in a wellbore and filtering fluid.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. Often debris needs to be removed from the wellbore after it is drilled. The debris can have different sizes from fine to large.

SUMMARY

An embodiment of a debris removal apparatus includes a housing. The housing has a chamber located therein. The chamber has at least one closed end. The debris removal apparatus can also include a first flow path. The first flow path can be in communication with an opening in the first end of the housing. The first flow path can also have an exit, and a diverter can be located adjacent to the exit. A port can be located between the diverter and the exit of the first flow path. The port can be in fluid communication with the first flow path and the chamber. The chamber can be in communication with a second flow path, and a screen operatively positioned between the chamber and second flow path.

An example system for removing debris from a wellbore can include a pump in communication with a debris removal apparatus.

An example method of removing debris from a wellbore includes flowing debris laden fluid into a first flow path located in a housing. The method also includes flowing the debris laden fluid from the first flow path to a closed chamber located in the housing, and flowing the debris laden fluid from the chamber to a second flow path, wherein the debris laden fluid is filtered while flowing to the second flow path, forming clean fluid.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
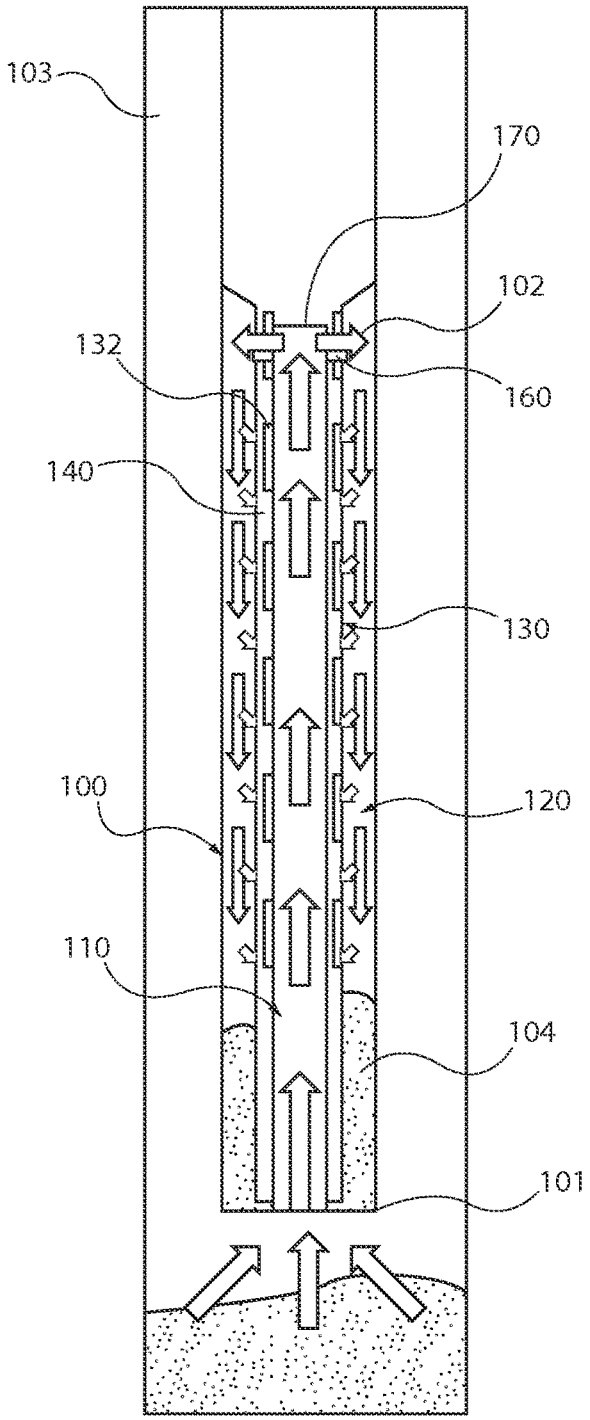
FIG. 1 depicts a schematic of an example debris removal apparatus.

FIG. 1 depicts a schematic of an example debris removal apparatus. The debris removal apparatus 100 includes a housing 101. A first flow path 110 is located within the housing 101. The first flow path 110 is in communication with a wellbore 103. The first flow path 110 can be separate from the housing, formed into the housing, or otherwise located within the housing.

The first flow path 110 is in communication with one or more ports 160. A diverter 170 is operatively located adjacent the port 160. The diverter 170 changes the direction of fluid exiting the first flow path 110; thereby causing it to flow out the one or more ports 160. The ports 160 are in communication with a chamber 120.

The chamber 120 has a closed bottom end, thereby allowing debris recovered from the wellbore to be trapped and stored in the chamber 120. The chamber 120 is in communication with a second flow path 140, and a screen 130 is located between the chamber 120 and second flow path 140; therefore, the screen 130 filters fluid flowing from the chamber to the second flow path 140.

In operation, the debris laden fluid 102 is sucked from a wellbore 103 into the first flow path 110. The debris laden fluid 102 flows through the first flow path to an exit end of the second flow path, and the diverter 170 causes the debris laden fluid 102 to flow through the one or more ports 160. The debris laden fluid 102 flows to the chamber 120, and the increase flow area in the chamber 120 causes a drop in the velocity of the debris laden fluid 102. The drop in velocity of the debris laden fluid 102 allows large debris 104 to settle out of the fluid. The large debris 104 is stored in the chamber 120. The fluid then flows through the screen 130 to the second flow path 140. As the fluid flows through the screen 130, fine particles are removed from the fluid, forming clean fluid 132. The clean fluid 132 flows through the second fluid flow path 140. The second flow path 140 can be in communication with a pump, and the clean fluid 132 can flow to the pump and be exhausted back into the wellbore.

Figure 2:
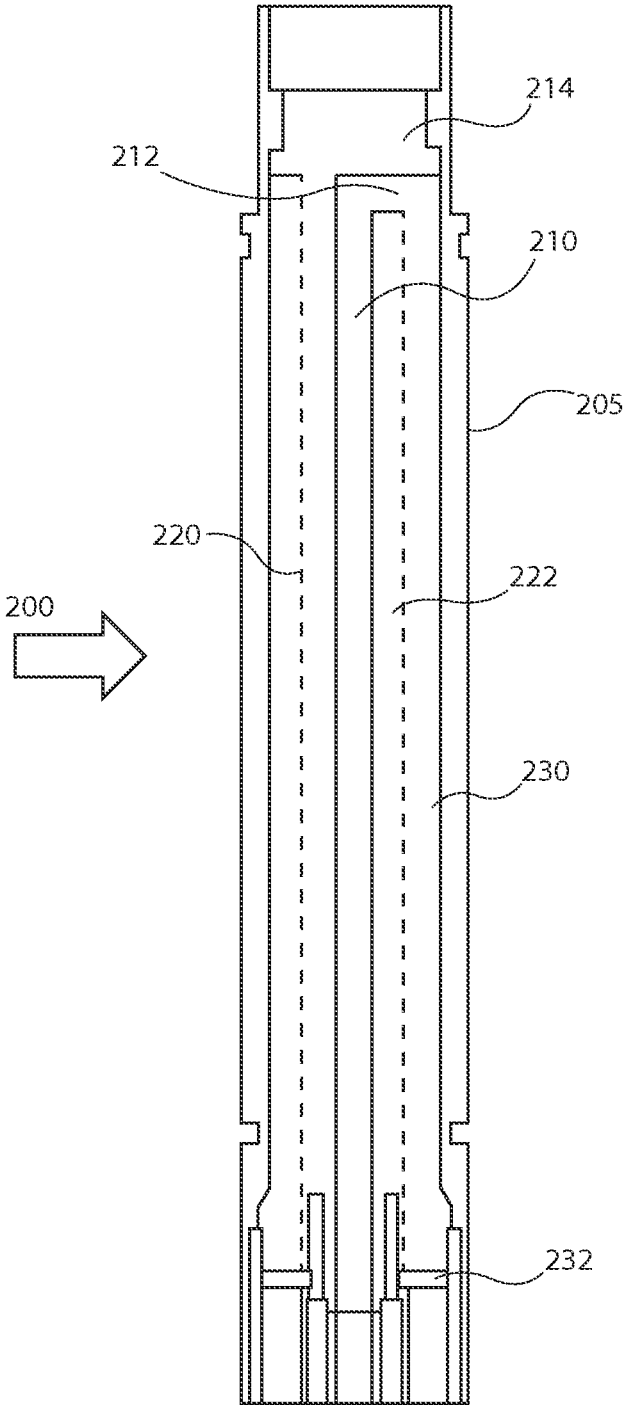
FIG. 2 depicts an example debris removal apparatus.

FIG. 2 depicts an example debris removal apparatus. The debris removal apparatus 200 includes a housing 205. A first flow path 210 is located in the housing 205. The first flow path 210 is in communication with the exterior of the housing 205. One or more ports 212 are located adjacent an exit end of the first flow path 210. A diverter 214 is operatively located in the housing 205. The diverter 214 is configured to divert fluid flowing in the first flow path 210 into the one or more ports 212. The ports 212 are in fluid communication with a closed chamber 230. The chamber 230 can be closed at one end by the diverter 214 and at the other end 232. The chamber 230 is in communication with a second flow path 222. A screen 220 is disposed between the second flow path 222 and the chamber 230. The second flow path 222 can be in communication with a pump.

Figure 3:
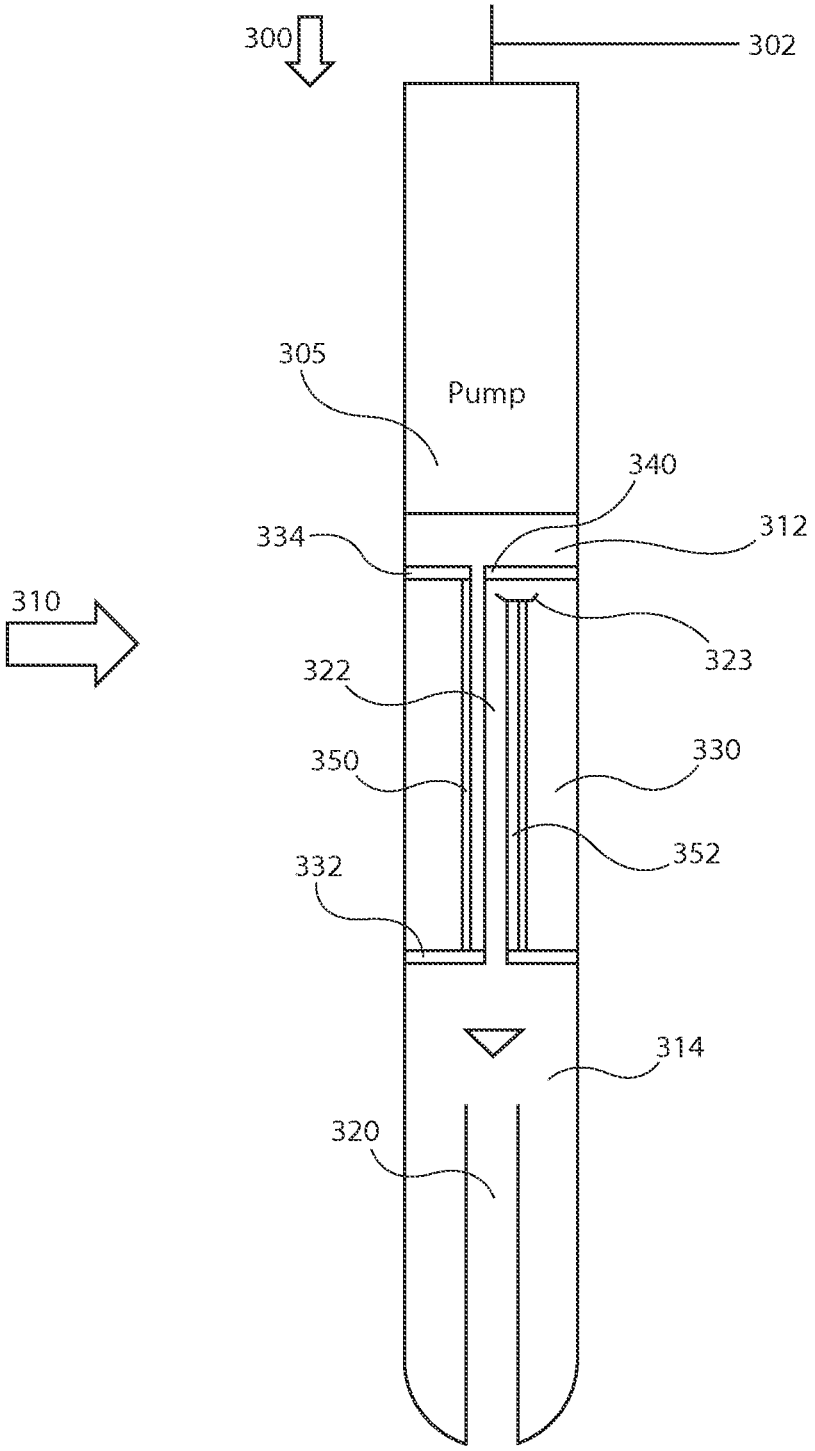
FIG. 3 depicts an example system to remove debris from a wellbore.

FIG. 3 depicts an example system to remove debris from a wellbore. The system 300 includes a pump 305 and apparatus to remove debris 310. The pump 305 is connected with a cable 302. The cable 302 is used to convey the system 300 into a wellbore. The apparatus to remove debris 310 includes a housing that has an upper portion 312 and a lower portion 314. The lower portion 314 has a first portion 320 of the first flow located therein.

The upper portion 312 has a second portion 322 of the first flow path at least partially located therein. The upper portion 312 also has the chamber 330, the second flow path 352, one or more ports 323, and a diverter 340 located therein. The chamber 330 is closed at one end by a plug 334 and the other end by a floor 332. The one or more ports is in fluid communication with the second flow path 352 and the chamber 330. The diverter 340 is operatively arranged adjacent an exit of the second portion 322 of the first flow path. The diverter 340 causes the fluid flowing in the second portion 322 to flow into the one or more ports 323. The fluid flows out of the one or more ports 323 to the chamber 330.

In operation, debris laden fluid can be sucked into the lower housing portion 312, by causing a pressure differential in the housing using the pump 305. The debris laden fluid flows through the first portion 320 of the first flow path. A gap between the first portion 320 and second portion 322 causes the debris laden fluid to undergo a velocity drop, allowing large debris to settle out of the debris laden fluid. The large debris is stored in the lower portion 312. The debris laden fluid then flows into the second portion 322 of the first flow path, and the velocity of the debris laden fluid is increased. The debris laden fluid undergoes a direction change at the exit of the second portion 322 of the first flow path. The change in direction is caused by the diverter 340. The fluid, due to the change in direction, flows to the one or more ports 323 and is discharged into the chamber 330. The debris laden fluid in the chamber 330 has a reduced velocity allowing additional debris to settle out and be trapped in the chamber 330. The debris laden fluid then flows through the screen 350 to the second flow path 352. The screen 350 filters out fine particles in the debris laden fluid; thereby, forming clean fluid. The clean fluid then flows in the second flow path 352 to the pump 305. The pump 305 discharges the clean fluid back into the well.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A debris removal apparatus to remove debris from wellbores, wherein the debris removal apparatus comprises:
- a housing;
- a chamber located within the housing, wherein the chamber has a closed end;
- a first flow path in fluid communication with an opening in the first end of the housing;
- a diverter adjacent an exit of the first flow path;
- a port in fluid communication with the chamber, wherein the port is located between the diverter and the exit of the first flow path, wherein the port is in communication with the chamber;
- a second flow path in communication with a second end of the housing, wherein the second flow path is in fluid communication with the chamber, wherein the second flow path and first flow path are parallel to one another, and wherein the flow in the second flow path and first flow path is towards the diverter, and wherein the flow in the second flow path bypass the diverter; and
- a screen operatively positioned between the chamber and second flow path, wherein the screen is disposed about the second flow path, and wherein the screen is parallel to the first flow path and runs the length of the chamber.

2. The debris removal apparatus of claim 1, wherein the housing is bifurcated, and wherein a lower portion of the housing is separated from the upper portion of the housing by an end of the chamber, and wherein the first flow path is in fluid communication with the lower portion, and wherein the exit of the first flow path, the second flow path, and the screen are located in the upper portion.

3. The debris removal apparatus of claim 2, wherein the first flow path has a first portion located in the lower portion and a second portion at least partially located in the upper portion, and wherein there is a space between the first portion and second portion.

4. The debris removal apparatus of claim 1, wherein the second flow path is in communication with a pump.

5. A system for removing debris from a wellbore, wherein the system comprises:
- a pump; and
- a debris removal apparatus, wherein the pump is connected with the debris removal apparatus, wherein the debris removal apparatus comprises:
  - a housing;
  - a chamber located within the housing, wherein the chamber has a closed end;
  - a first flow path in fluid communication with an opening in the first end of the housing;
  - a diverter adjacent an exit of the first flow path;
  - a port in fluid communication with the chamber, wherein the port is located between the diverter and the exit of the first flow path, wherein the port is in communication with the chamber;
  - a second flow path in communication with the pump, wherein the second flow path is in fluid communication with the chamber; and
  - a screen operatively positioned between the chamber and second flow path, wherein the screen is concentrically disposed about the first flow path and the second flow path, and wherein the screen runs from the closed end to proximate the diverter.

6. The debris removal apparatus of claim 5, wherein the housing is bifurcated, and wherein a lower portion of the housing is separated from the upper portion of the housing by an end of the chamber, and wherein the first flow path is in fluid communication with the lower portion, and wherein the exit of the first flow path, the second flow path, and the screen are located in the upper portion.

7. The debris removal apparatus of claim 6, wherein the first flow path has a first portion located in the lower portion and a second portion at least partially located in the upper portion, and wherein there is a space between the first portion and second portion.

8. The debris removal apparatus of claim 5, wherein the second flow path is in communication with the pump.

9. A method of removing debris from a wellbore, wherein the method comprises:
- flowing debris laden fluid into a first flow path located in a housing;
- flowing the debris laden fluid from the first flow path to a closed chamber located in the housing; and
- flowing the debris laden fluid from the chamber to a second flow path, wherein the debris laden fluid is filtered while flowing to the second flow path, forming clean fluid, wherein clean fluid flow and the debris laden fluid flow are parallel to one another.

10. The method of claim 9, further comprising causing a velocity drop in the debris laden fluid in the chamber allowing large debris to drop out.

11. The method of claim 9, further comprising providing a space between a first portion of the first flow path and a second portion of the first flow path, and wherein large debris falls out as the debris laden fluid flow from the first portion to the second portion.

12. The method of claim 11, further comprising collecting large debris in a lower portion of the housing.

13. The method of claim 9, further comprising exhausting the clean fluid back into the wellbore.

* * * * *